US009173800B2

(12) United States Patent
Pessinen

(10) Patent No.: US 9,173,800 B2
(45) Date of Patent: Nov. 3, 2015

(54) DEVICE FOR ASSISTING CHILDBIRTH

(75) Inventor: Eija Pessinen, Helsinki (FI)

(73) Assignee: RELAXBIRTH OY, Espoo (FI)

( * ) Notice: Subject to any disclaimer, the term of this patent is extended or adjusted under 35 U.S.C. 154(b) by 516 days.

(21) Appl. No.: 12/992,846

(22) PCT Filed: Sep. 11, 2008

(86) PCT No.: PCT/FI2008/050504

§ 371 (c)(1),
(2), (4) Date: Nov. 15, 2010

(87) PCT Pub. No.: WO2009/138548

PCT Pub. Date: Nov. 19, 2009

(65) Prior Publication Data

US 2011/0067180 A1 Mar. 24, 2011

(30) Foreign Application Priority Data

May 16, 2008 (WO) ..... PCT/FI2008/050279

(51) Int. Cl.
*A61G 15/00* (2006.01)
*A61G 13/00* (2006.01)

(52) U.S. Cl.
CPC ..... *A61G 15/005* (2013.01); *A61G 13/0009* (2013.01)

(58) Field of Classification Search
CPC ..... A61G 15/005; A61G 13/0009
USPC ..... 5/600, 602, 81.1 RP, 81.1 R, 86.1; 297/423.37
See application file for complete search history.

(56) References Cited

U.S. PATENT DOCUMENTS

| | | | | | |
|---|---|---|---|---|---|
| 2,375,907 | A | * | 5/1945 | Farmer | 5/86.1 |
| 2,975,435 | A | * | 3/1961 | Forrest | 5/507.1 |
| 3,137,528 | A | * | 6/1964 | Bottemiller | 297/423.37 |
| 3,310,816 | A | * | 3/1967 | James et al. | 5/83.1 |
| 4,180,062 | A | | 12/1979 | Alberti et al. | |
| 4,221,370 | A | * | 9/1980 | Redwine | 5/613 |
| 4,527,555 | A | * | 7/1985 | Ruf | 602/39 |
| 4,703,975 | A | | 11/1987 | Roberts et al. | |
| 4,715,592 | A | | 12/1987 | Lewis | |
| 4,940,286 | A | * | 7/1990 | Nguti | 297/423.37 |
| 5,129,117 | A | | 7/1992 | Celestina et al. | |
| 5,201,377 | A | * | 4/1993 | Wilson | 180/6.5 |

(Continued)

FOREIGN PATENT DOCUMENTS

| | | | |
|---|---|---|---|
| DE | 20010364 | U1 * | 10/2000 |
| DE | 200 10 364 | U1 | 11/2000 |
| EP | 1 782 785 | A1 | 5/2007 |
| FI | U20060202 | | 5/2006 |
| FR | 2 591 887 | | 6/1987 |

(Continued)

*Primary Examiner* — David E Sosnowski
*Assistant Examiner* — Eric Kurilla
(74) *Attorney, Agent, or Firm* — Muncy, Geissler, Olds & Lowe, P.C.

(57) ABSTRACT

A device for assisting parturition, which device can be used to practice delivery, in birth training, in delivery, and in post natal and other rehabilitation. The device includes a body part and a seat part for the woman in labor. In the seat part there is a cut-out for the exit of the baby. The seat part is connected to the frame part, and in the device there are support elements which the woman in labor can grip, and on which she can lean in various delivery positions. The seat part is attached to the body in such a way that the cut-out faces away from the body and the elements for attaching to the body are between the body and the seat part. The seat part can be turned laterally relative to the body.

18 Claims, 5 Drawing Sheets

(56) References Cited

U.S. PATENT DOCUMENTS

Figure 1:
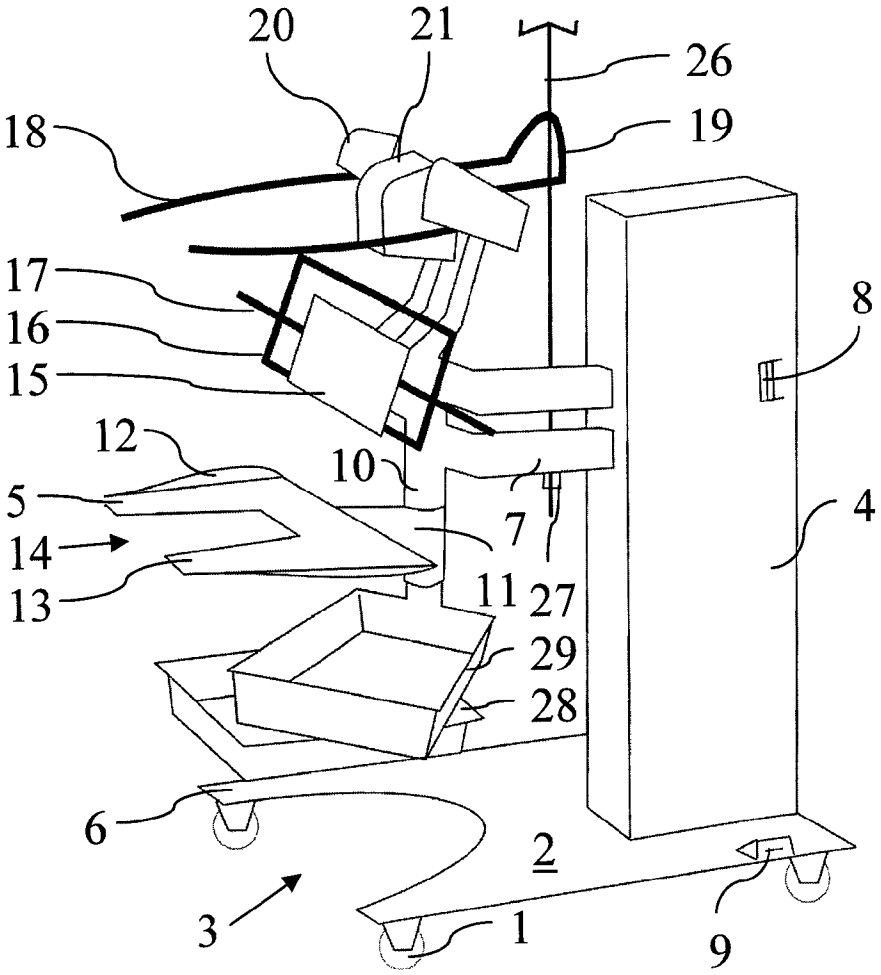

| | | | | |
|---|---|---|---|---|
| 5,586,352 | A * | 12/1996 | O'Brien et al. | 5/662 |
| 5,664,266 | A * | 9/1997 | Williams et al. | 5/86.1 |
| 6,086,085 | A * | 7/2000 | Larsson | 280/648 |
| 6,857,153 | B2 * | 2/2005 | Ruehl et al. | 5/600 |
| 6,948,202 | B2 * | 9/2005 | Weismiller | 5/624 |
| 6,957,457 | B2 * | 10/2005 | Stryker et al. | 5/602 |
| 7,340,784 | B2 * | 3/2008 | Stryker et al. | 5/81.1 HS |
| 8,316,480 | B2 * | 11/2012 | Burak et al. | 5/87.1 |
| 8,650,676 | B2 * | 2/2014 | Lin | 5/87.1 |
| 2004/0226094 | A1 * | 11/2004 | Heimbrock et al. | 5/618 |
| 2009/0144895 | A1 * | 6/2009 | Bostelman et al. | 5/87.1 |
| 2010/0187890 | A1 * | 7/2010 | Alessandro | 297/423.37 |
| 2011/0156465 | A1 * | 6/2011 | White | 297/423.37 |

FOREIGN PATENT DOCUMENTS

| | | | |
|---|---|---|---|
| FR | 2591887 | A1 * | 6/1987 |
| GB | 817789 | | 8/1959 |
| GB | 2 127 296 | A | 4/1984 |
| GB | 2127296 | A * | 4/1984 |
| GB | 2 169 500 | A | 7/1986 |
| JP | 1104225 | A * | 2/1999 |
| JP | 11042258 | A * | 2/1999 |
| JP | 3723327 | | 9/2005 |
| JP | 2006-325706 | | 12/2006 |
| SE | 468 745 | | 3/1993 |
| WO | WO-93/09750 | | 5/1993 |
| WO | WO-94/09740 | | 5/1994 |
| WO | WO-00/23027 | | 4/2000 |

* cited by examiner

DEVICE FOR ASSISTING CHILDBIRTH

SCOPE AND FIELD OF USE OF THE INVENTION

The present invention relates to a device used to assist childbirth, which can be used to practise childbirth, in childbirth training, in delivery, and in post natal and other rehabilitation.

BACKGROUND

Various kinds of birthing chairs, stools, beds, and frames are known, which do not, however, as the present invention does, suit both to floor use and for attachment or connection, for example, to a conventional bed or a hospital bed and being located on top of, or above the bed. Known solutions also cannot be lifted on top of the bed, without it preventing the bed from being simultaneously used normally and obstructing the need of a parturient to change position and move her body freely. The birthing bed and chair solutions restrict changing of the birthing position and do not take into account the work ergonomics or work safety of the staff or hygiene risks. When giving birth in a prone position, the loading on the sacro-iliaca (SI) joints may cause pain in both the pelvic and back areas. In stool and chair births, the working position of the staff is often uncomfortable because their back may be in a physically overloaded position for a long time.

At floor-level, birthing, excretions create hygienic and slipping risks for those in the room. In addition, solutions external to the bed slow down the rapid transfer of the parturient to the operating theatre in emergencies.

KNOWN SOLUTIONS

Various solutions for birthing chairs and birthing beds are known.

In the publication WO94109740, when the woman in labour leans forward, the staff must crouch on the floor in a particularly poor ergonomic position. There is a risk of contamination, due to splashing of excretions.

In the solutions of SE 468 745 and GB 2 127 296, the hands and shoulders of the woman in labour are raised, which can cause pressure on nerves and numbing of the hands. Neither of these solutions can be used on top of a bed in such a way that the birthing bed would be at the same time available in a normal way. In the crouching birth solution of GB 2 127 296, the woman in labour must keep her legs sharply bent. Due to this position, transfer to the operating theatre will be delayed in emergencies.

In the birthing chair solution of SE 468 745, the position of the woman in labour loads the joints of the lower leg and back and the pelvic area. Due to this position, transfer to the operating theatre becomes complicated in emergencies.

In the birthing bed in publication PCT/AT92 00145, the so-called transverse table is separate. In kneeling labour and when hanging, the hands of the woman in labour become tired. Pushing in the positions shown is against gravity. The wide bed may not necessarily fit through standard-sized doors, if there is a need to transfer quickly to the operating theatre.

In the obstetric chair of publication GB 2169500A, due the angle of the backrest a kneeling birth becomes difficult. The hands of a crouching parturient are raised at a higher angle, which may cause numbing and a weakening of blood circulation.

In the solution of U.S. Pat. No. 4,703,975, pushing is only possible sitting and supported by the hands from below, due to which the staff must work in a non-ergonomic position. The chair in question cannot be placed on top or above a birthing bed, without interfering with the bed's normal use. Utility model U2006202 corresponds to the general prior art, in which birth takes place near the floor and the midwife must work in an ergonomically unfavourable static position.

All the known birthing chairs and corresponding constructions attempt to resolve only the final stage of the pushing phase, and cannot be used for the entire duration of the delivery. The known solutions prevent unhindered change of the labour position. Thus the parturient is continuously in a static numbing position.

The maximum angle of the known birthing beds is typically about 70 degrees. In the back position, lifting the end of the bed to a more vertical position does not eliminate the birth ergonomic problem of pushing into a raised angle against gravity.

The birthing table of JP2006325706A and the birthing bed disclosed in the publication U.S. Pat. No. 5,129,117 are designed for prone deliveries, and the possibilities for the parturient of vertical pushing is limited to a semi-sitting and kneeling position.

The solution of WO 00/23027 is available during delivery only once and for a short time during the administration of spinal or epidural anaesthesia. The device cannot be used at other stages of delivery.

In spite of several different kinds of devices intended for the various stages of delivery, no device so far exist which can facilitate childbirth in its various stages for both the parturient and the staff assisting in the delivery.

The present invention is intended to create a device, with the aid of which delivery can be assisted in various birthing positions.

One embodiment of the invention is intended to create a device, with the aid of which the work ergonomics of staff assisting in the delivery can be improved.

Further, one embodiment of the invention is intended to create a device, with the aid of which it is possible to both practice and prepare for the actual delivery as well as to provide rehabilitation after childbirth.

One embodiment of the invention is intended to create a device, which can be freely moved and placed in connection with a birthing bed or other appropriate bed.

One embodiment of the invention is intended to create a device, which can be attached to a birthing bed, or to some other appropriate bed.

Further, one embodiment of the invention is intended to create a device, which will facilitate the transfer of the parturient to a bed after the birth.

ADVANTAGES OF THE INVENTION

The following describes advantages that are achieved with the aid of various embodiments of the invention.

The invention introduces new alternatives and possibilities for childbirth, for taking care of and assisting the birth and for selecting the delivery position. The physical strain of staff assisting in the delivery is spread more evenly since the device according to the invention permits optimal working positions for the staff. The staff is able to raise the seat part of the device and the parturient, either manually, mechanically, using a pedal, hydraulically, pneumatically, or electrically to such a height at which the parturient can be assisted from an ergonomic working height. If necessary, the birthing aid can be attached to any bed or support base whatever, or it can have its own stand, so that the device can be moved easily. Thus, the same device can be used in the opening phase of the delivery as a support, for example, in a standing position, while the actual delivery can take place in connection with a bed, using the same device as an aid. As the same device is used the whole time, control of the birth event is easier for both the parturient and the midwife. In addition to the seat part, the support surfaces and hand rests in the device move simultaneously, so that they need not be separately adjusted when the height is changed. If necessary, desired possibilities for adjustment may of course be included in the device.

When turned on top of the bed, or above or outside it, the device can be used to provide the staff with an optimal working position in terms of work ergonomics. Also in complicated deliveries the working posture of the staff becomes more ergonomic and the use of hand force and body becomes more effective for both the parturient and the staff.

In the easily adjusted device, account has been taken of the working ergonomics, protection, hygiene, and work welfare of the entire staff, as well as the safety of the parturient, the child being born, the support persons, the spouse, and staff. In the shapes and surface solutions, account has been taken of the cleaning of the birthing frame and the support base and as well as high hygienic requirements. Safety is increased by the staff having simultaneous contact with both the child being born and the parturient.

The device according to the invention can be unrestrictedly utilized throughout the entire birthing, from childbirth preparation to post natal recovery and rehabilitation. If the device is equipped with steerable wheels, the movable stand allows the device to be used for practice and relaxation also outside of the birthing room. Thus transfer to the delivery room can take place at a suitable stage for the parturient and preparations for delivery can continue as desired for as long as possible in more relaxed conditions, before moving on to the actual delivery. The support base of the birthing aid is shaped in such a way that a standing woman can safely and without injuring her legs lean on or be supported on the leaning support and rest surfaces. The support base of the movable device is safe for women of different sizes. A support person or spouse can stand on top of the support base and at the same time massage the back of the parturient. This is assisted by the device's asymmetrical shape, in which the frame of the device is located at the side of the support base. Thus the support person can stand at the side of the frame and have good contact with the parturient.

If necessary, the device used for assistance in birthing is independent of a bed or support base. Thanks to the extensive height adjustment and movement possibilities, it can be located outside the delivery room, next to a bed, at the end of, lengthwise at the side, at an angle to, and even on top of, or outside of the bed. Thanks to the quick-release locking or separate stand, the device can quickly be moved away from near the bed, so that it will not prevent the parturient from being moved on the bed to the operating theatre.

The versatilely adjustable and movable aid enables the parturient to easily change position. When located in the floor position, next to the bed, on top of the bed, and above the bed, the device permits the parturient to freely move her body in different directions. The great degree of adjustability of the device and its parts vertically, horizontally, at an angle, and by rotation, permits a device attached to the bed to be raised and moved in such a way that problem-free normal use of the bed is possible. A movable device can naturally be more easily moved away from being connected with the bed.

The wide range of adjustable settings of the device can be and equipped with memory according to who is using the device.

The dimensioning of the device, in terms of the seat part, the leaning supports, and the hand rests, is suitable for parturients of nearly all sizes, so that these parts need not necessarily be adjustable in terms of distance from each other. This is based, on the one hand, on the fact that the differences in size between people's bodies are smaller than their differences in overall height and, on the other hand, on that the user can select for herself a suitable position on the device, without being restricted by the structure of the device. Of course, if desired, the adjustability can be increased if required. The use of the seat part is facilitated by its shape and lengthened seat part. The width of the seat and the hand rests of the device enables the position to be changed at different phases of delivery. The easy change in position is essential in maintaining the mobility of the parturient and managing birth pain. Especially during a long delivery, remaining in the same position causes stress to the skeleton and muscles, which leads to an increase in the sensation of pain. Because it is possible to change position relatively freely on the device, it is possible to find the position with the least birth pain at each moment during the delivery. In addition, it should be noted that finding an easy position and relaxation for the parturient will relieve pain.

The seat part can be removable for cleaning. The seat can be turned aside for cleaning and for relaxation by standing, and the turning of the seat will also facilitate transferring the parturient onto a bed after the delivery. If necessary, seat parts of different sizes can be used, so that the size of the parturient can be taken into account. The seat part can be turned down mechanically, electrically, or manually, in such a way that it also acts simultaneously as a sliding base and a safety edge when transferring to the bed. In addition, the seat prongs of the seat part can be detachable, to facilitate moving to the bed.

With the aid of the shaped widenings at the sides of the seat (supports for moving the body), changing between pushing and resting positions is easier. When using the seat, the parturient can also hold onto the movable or fixed hand rests in the manner that suits her best. During labour, the parturient can support herself either on the movable armrests or the body-supports of the set and the detachable footrests.

The newborn child can be lifted onto a heatable cradle-like child table, which can be attached to the frame of the birthing frame or to a support structure attached to the bed. The cradle-like structure allows the newborn child to also be cared for on the table. Excretions can be collected in an easily cleaned and detached collection vessel attached to either the frame of the birthing frame or to the bed. The collection vessel can also be used in other operations. An instrument tray or other frames can be attached to the frame or bed.

If desired, a reading frame or similar support, on which devices distracting the thoughts from the delivery, communications devices, entertainment electronics, or remote controls, can be attached to the device.

According to one feature of the invention, the device can also be used in rehabilitation, in therapeutic exercises, and in post natal recovery. The solution can also be utilized in other rehabilitation for recovering or developing the muscle power of the body.

Care devices, care monitors, and similar devices can be attached to the device.

PROPERTIES OF THE INVENTION

In a bed, the birthing aid can be located in a manner allowed by the space either at the end or the long side of the bed, inside or outside the bed, and in free space in or outside the actual delivery room. Thanks to the support base and movability, the device can be located or attached in connection with any kind of bed whatever. Thanks to the fact that the seat part and the related supports and handholds for the parturient are liftable, the parturient can be get to a suitable height and the staff can assist her at an optimal working height, so that assisting the birth is easiest. The seat part and related support members are preferably raised and lowered electrically, or with the aid of some other kind of operating device. Thus, the parturient can herself adjust the height with the aid of the control devices. The height adjustment taking place with the aid of electrical or other power devices also facilitates the work of the staff.

As the woman in labour can be brought to the correct height so that the midwife or obstetrician has an unobstructed view of the area of the external genital organs without having to stoop, they will be better able to assist in the delivery. The use of the device reduces the need for interventions, i.e. the number of ventouses, caesarean sections, and similar, which will be better for both the woman and her womb. On the other hand, vacuum extractor (ventouse) and breech deliveries will be easier and more ergonomic. It will be easier to ease the shoulders of the baby out and the time when the baby is being compressed will be reduced. This will reduce the amount damages. The pushing phase will be more effective whereby the baby's oxygen supply is improved. Because the person assisting will be able to support the parturient's perineum better, the number of tears and the risk of bleeding will be reduced. In the same way, the placenta can be removed more safely and easily. The birthing bed is available the whole time, for instance, for sampling fetal scalp blood. The more effective pushing phase, the not fixed but freely selected position of the parturient, and the improved work ergonomics of the midwife or obstetrician, will thus substantially improve the welfare of the baby and mother and the work health of the staff.

Preparation for birth can be performed using the same device that is used in delivery. Preparation is used to relax the dilatation phase of the cervix by leaning on the device or stretching the body. Relaxation reduces the muscular resistance in the birth canal, so that delivery is easier and faster. Also pushing phase is facilitated and shortened and position can also be changed during the pushing phase. Thus for the mother, the device according to the invention facilitates the delivery in its entirety and fears of childbirth are reduced, due to the easier delivery and good preparation facilitated by the device.

A device attached to a bed can be dimensioned in such a way that the dimensions do not exceed the width of the bed. The device can also be easily and safely moved on wheels to rooms outside the delivery room, for example, for practice use, or for use in the initial stages of labour. The seat part of the device and the elements supporting the parturient can be manually or automatically raised, turned, and moved, and if necessary folded and locked in a safe storage assembly.

The birthing aid can be located to be attached to a bed or next to a bed, or to be secured above a bed or on a wall. The device can be placed or attached on the long or short side of the bed, when its support base is attached (or connected) to the bed by quick-release attachments. The raising and lowering of the birthing frame can take place, according to the level of equipment selected, either mechanically, pneumatically, hydraulically, or electrically. If desired, the raising and lowering of the birthing aid can be implemented simultaneously with the movements of the bed, for example, controlled by sensors, or the device can be completely independent of the bed. Thanks to the quick-release locking, a device locked to a bed can, if necessary, be quickly detached from the bed, for example, when being transferred to the operating theatre. The birthing frame can be equipped with steerable wheels to ensure easy movability and possibly with a remotely controlled steering apparatus.

The appropriate parts of the device can be cushioned to create a comfortable support or hand rest. The woman in labour has alternative places to rest her hands or to hold onto during delivery. The parturient can also alternatively be supported on lower movable or fixed supports. In sitting, kneeling, and crouching delivery situations, diapers or collection vessels can be placed under the parturient.

A movable leaning support can also act as a face, forehead, cheek, jaw, or neck support. When leaning on the birthing frame, the parturient can support her sternum on a padded and adjustable leaning support and rest her hands on the relaxation support. The leaning support can be adjusted to different positions while the parturient's arms can be at a downward slant on the resting base. A bookrest or similar support frame for various devices can be attached to a curved part or close to it.

The support base of the device is shaped in such a way that a standing woman can lean safely on the leaning support and the resting bases and turn freely through 360 degrees. In addition, the movable support base has a safe structure, so that women of different sizes can easily use the device. There is a place on top of the support base for support person and the spouse.

The seat part can be detached, moved, tilted, or lifted backwards, in such a way that it is easy to keep clean and will not form safety hazards when the support base is moved. The ends of the seat can be detached and there can also be a controlled tilting down functionality on top of the bed. The easily cleanable and detachable collection vessel attached to the device frame or the bed can also be used for other operations while correspondingly a heated cradle-like child table, in which a newborn child can be cared for or, if necessary, revived, can be attached to the frame or a support structure attached to the bed.

When using the device with its seat part outside the bed, easily attached and detached footrests can be used, which can be vertically and horizontally adjustable extensions attached to the frame or bed. A sitting parturient can use pushing shoes attached to the bed frame or the birthing frame to increase pushing power.

BRIEF DESCRIPTION OF THE DEVICE

The invention is based on the fact that the seat part and at least one set of elements, on which the parturient supports herself, are aligned away from the frame of the device and the seat part can be turned around at least one axis of rotation to the side from the operating position.

According to one embodiment of the invention, the frame of the device is attached to the support base in such a way that it is to the side of the centre line of the support base.

According to one embodiment of the invention, the device can be attached to a birthing bed or other appropriate bed, or to some other support base.

According to one embodiment of the invention, there is a cut-out in the support base of the stand, which faces away from the frame, so that a parturient can stand in the recess.

According to one embodiment of the invention, there is a counterweight in the support base, on the opposite side of the frame to the seat part, to compensate for the weight of the parturient and to stabilize the device.

According to various embodiments of the invention, there are at least two support surfaces in the device, on which the parturient can support herself, and at least two elements located in different ways, on which the parturient can support herself with her hands.

More specifically, the device, according to the invention, for assisting birthing, is characterized by what is stated in the characterizing portion of Claim 1.

Other advantageous and characteristic features of the device according to the invention are presented in the dependent Claims.

DETAILED DESCRIPTION OF THE INVENTION AND DRAWINGS

Figure 2:
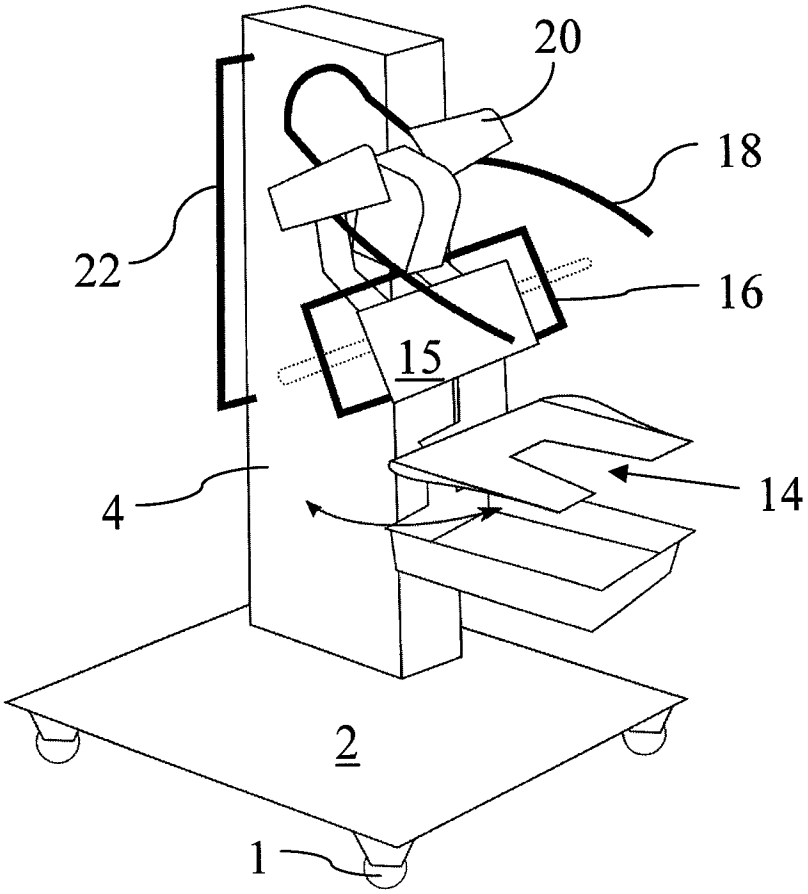
Figure 3:
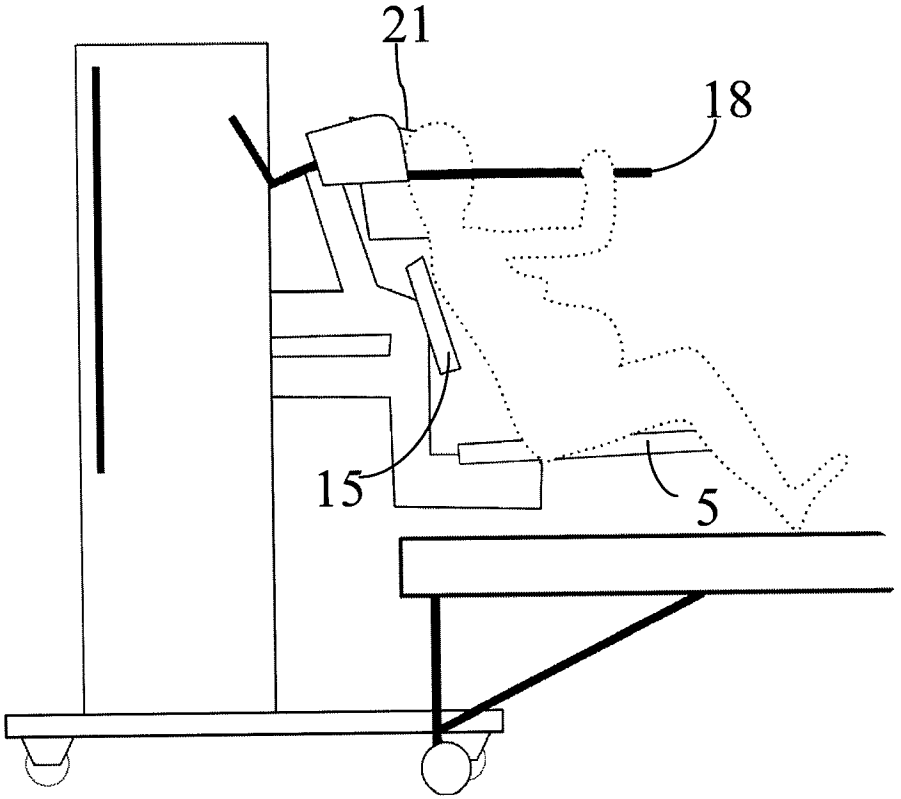
Figure 4:
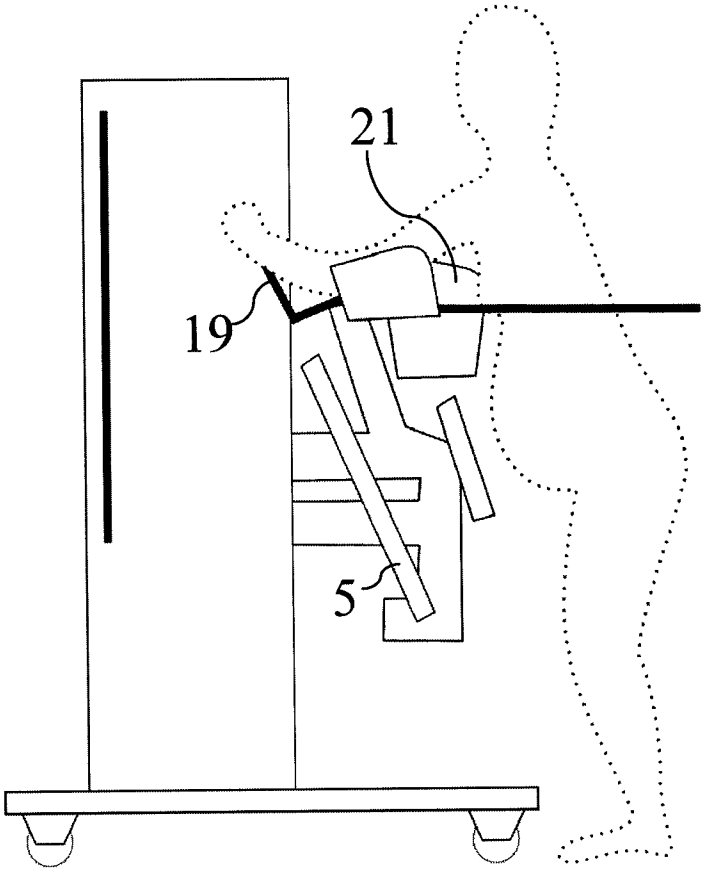
Figure 5:
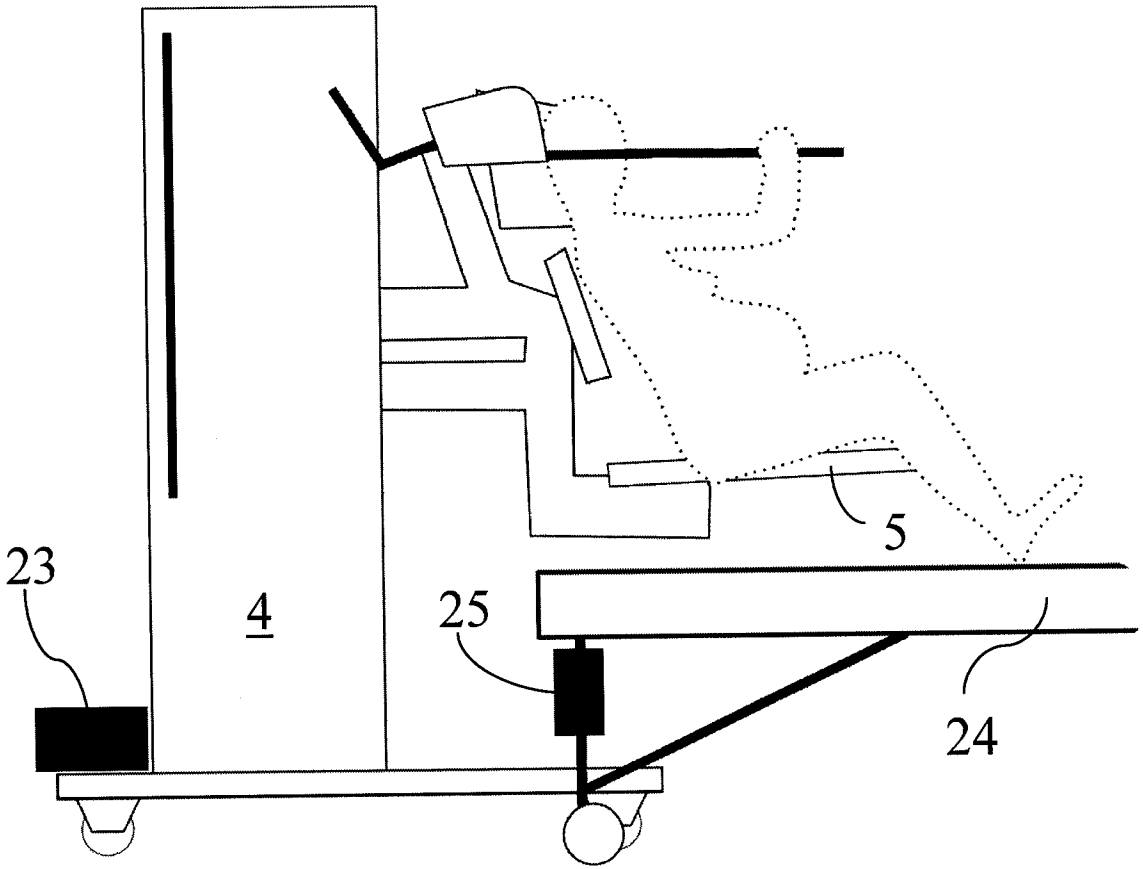

In the following, the invention is described in greater detail with reference to the drawings, in which FIG. 1 shows one device according to the invention, seen from a first direction, FIG. 2 shows the device of FIG. 1, seen from a second direction and in a different assembly, FIG. 3 shows one way of using the device, FIG. 4 shows a second way of using the device, FIG. 5 shows further one alternative assembly of the device.

FIG. 1 shows an embodiment of the device, in which there is a support base 2 equipped with wheels 1. This device can be moved on the wheels 1, so that it can easily be used for both preparation for birth and in the actual delivery itself. The set of wheels can be equipped with a brake device, which is connected to a so-called dead-man's handle, which locks the brakes, if the handle is released. This ensures that the device cannot move without control. The brake function can also be accomplished in such a way that the support base is lowered when the handle is released, but in that case care must be taken to ensure that the gap between the support base 2 and the floor is so small when the device is raised on the wheels that the foot of the parturient, or of a support person cannot fit into the gap between the support base 2 and the floor. In the support base, there is a cut-out 3, which faces away from the frame of the device and opens at the seat base 5 and the support elements for the parturient. Thanks to cut-out 3, the parturient can stand and lean on the support elements, without having to get on top of the support base 2. Thus the cut-out helps to increase safety, as the parturient can now move the whole time on an even floor, without having to stand on the threshold formed by the support base (FIG. 4). The cut-out 3 additionally facilitates the placing of the device partly or entirely under the birthing bed. Now the prongs 6 at the sides of the support base can be longer, so that the device is more stable and safer. Alternatively, the support base 2 can be a unified plate, so that the parturient must stand on top of the plate, but in that case the parturient's weight will stabilize and support the device. Further, it can be seen from FIG. 2 that there is space on top of the base for the parturient's spouse or support person. Thus, they are close to her and see the delivery the whole time, and can massage the back of the parturient, and can face her and see the child being born. Their weight also stabilizes the device. The stability and immobility of the device are essential, especially during the pushing phase, because then the device is subject to large forces. If the device is stable, the parturient will trust the device and can concentrate better on pushing. Of course stability and trustworthiness are important already in the preparation and opening phases, because trust is then created in the functionality of the device.

In the device according to the invention for assisting childbirth, the body 4 of the device is fitted on top of the support base. The body contains the guides, on which the brackets 7 of the seat base 5 and the support elements are fitted. In order to move the brackets 7, it is possible to use an electric motor, a mechanically levered or pumped operating device, or possibly even a pneumatic or hydraulic operating device. Mechanical devices are cheaper, but more laborious to use. The guides and transfer devices required by the brackets 7 can be implemented in many way by one skilled in the art, so that it is not necessary to describe them here in greater detail.

The body 4 is preferably located at the side of support base, moved to the side of the centre line of the support base and in such a way that it is at the rear of the support base 2, relative to the direction of the seat part 5. The lateral transfer leaves space for a support person next to the body 4. The body 4 can be placed on either side of the centre line of the support base 2 according to the desired handedness of the device, and even in the centre, though placing the body in the centre will clearly restrict the actions of the support person. The body itself can consist of several parts, but a device equipped with a single vertical body 4 will have the most space around the body 4. The openings in the body 4, for example, for the brackets 7, are protected in such a way that excrement splashes cannot enter the body. This can be handled by using conventional seal solutions. In the body 4 there is further the so-called dead-man's handle 8 at the rear at about standing height, by means of which the movement of the wheels is released for moving the device. In the support base 2, there is a mechanical release 9 in case of a power outage, which can be used to raise the device onto wheels and ready for moving, even without the electrical functions.

In the device, there is a seat base 5 and various support and gripping elements for the parturient. These are fitted to an auxiliary frame 10, which is connected to the body 4 by brackets 7. There are preferably two brackets 7, which is the easiest way to make the structure torsionally stiff. Two strong brackets 7 also give a greater feeling of trustworthiness than one, so that in this way too the stress felt by a parturient in childbirth is eased. Seen downwards from the bracket arms 7, first there is the seat base 5 attached rotatably to the auxiliary frame. The seat base itself comprises a seat level, a cut-out 14 formed in it for the exit of the baby, and prongs 13 at the sides of the cut-out, and widenings 12 formed in the edges of the seat part. The cut-out and prong parts are directed away from the body 4, because then the midwife or obstetrician has a better access for assisting in the delivery, without being obstructed by the body. 4.

In this case, the seat base 5 rotates to the side around the vertical axis of the auxiliary frame 10, but alternatively a fixed arm, at the end of which a pivot is fitted, around which the seat part can rotate, can be fitted to the auxiliary frame. The rotating movement should preferably be lockable, so that the seat part can be made to remain securely in the desired position. The seat part 5 can be moved to the side by rotating it around the auxiliary frame 10, which facilitates transfer to a bed. The seat part can also be rotated up or down around its bracket arm 11, which facilitates washing of the device and its use in a standing position, when the seat part, of course, is not needed. In the vertical position, the seat part can be washed without having to stoop and strain one's back. The seat part 5 can be detached and changed, but while the device is in use it is attached to it permanently, so that a detached seat part would not become a hazard if it falls, or if someone trips on it. The shape and size of the seat part 5 can vary according to the size and shape of the body of the parturient, as well as to her weight. One important feature are the widenings 12 at the side of the seat part, which the parturient can hold onto if she wants to, and change the position of her body during the pushing phase. The widenings 12 also provide a good place to grip when moving from the seat part 5 to the bed after the birth. The seat part can be made to turn down, which will further assist moving to the bed. The adaptability of the seat part can be increased with detachable prongs 13, if necessary.

After the birth, the seat part and the entire device can be used in breast feeding, breast-feeding training, and post natal rehabilitation.

In the auxiliary frame 10 above the seat part 5 are the first support elements, which comprise a backrest 15 and an annular gripping handle 16 arranged in connection with it, as well as a transverse gripping bar 17. Both of these gripping elements can be in the device, or they can be used as alternatives. Above the first support elements are the second support elements, which comprise curved hand supports 18, a leaning cushion 21, and at its sides armrests 20 and a griping curved handle 19 on the opposite side of the curved hand supports 18.

The leaning cushion 21 is narrow and can be rotated around its attachment axis, so that it can be rotated to different positions, in order to provide different kinds of support. The leaning cushion 21 is narrow, so that it can support the sternum without pressing on the breasts when leaning on the device in a standing position. Alternatively, the leaning cushion 21 can be turned upwards so that one can lean one's brow or some other part of the head against it, according to the position desired by the parturient. When sitting, the leaning cushion 21 can be arranged to support the parturient's neck or the back of her head, if she wishes. The armrests 20 and the gripping curved handle 19 together form one leaning and gripping possibility when the device is used for preparation for delivery, or when giving birth standing or kneeling. A bookrest or other frames can also be attached to the gripping curved handle.

The curved hand supports 18 are pivoted at their ends, so that they can be moved laterally. The movement of these hand supports 18 is preferably synchronized, for instance, with a connecting rod, so that when one support is adjusted, the other moves on the same distance from a vertical line running through the centre of the seat part. The adjustment can be locked. Thus, the parturient can select the gap between the curved hand supports as she wishes while the locking holds them firmly in place. This permits optimal pushing effect and the use of the upper body while pushing and when changing the pushing direction. At the ends of the curved hand supports, there are preferably upwardly curved handle parts, or stops, which prevent the slippery and wet hands of a sitting parturient from sliding off the end of the support. The stops are preferably larger than the orbit of the eye, so that they will prevent eye damage from an impact with the handle. The upper curved hand supports help a parturient in the pushing phase to change position and facilitate moving onto the bed. The parturient can select the place to grip between the widenings 12 of the seat part and the curved hand supports 18. moving the back and changing the position will reduce the pain experienced by the parturient and the risk of hip injury. In addition to the hand supports, settling onto the bed is facilitated by the rotatability of seat part.

When settling onto the bed, the seat part is rotated first by about 30 degrees, whereupon the parturient can turn in the direction of the bed and, as settling progresses, the seat part is gradually turned away from under the parturient, as she moves down onto the bed. The annular gripping handle around the backrest permits a wider movement and gripping radius than straight handles and thus more diverse exercise movements, such as knee bends and unlocking the facet joints in the back.

FIG. 2 shows the parts and functions described above and additionally a pull bar 22 attached to the side of the body 4, by pulling on which the device can be moved. A support person standing at the side of the body can also hold onto bar 22, if they wish.

FIG. 3 shows the outline of a parturient and the accessory used in birthing, in connection with a birthing bed. It can be seen from the figure that the parturient can support herself on the leaning support 21, the backrest 15, and the seat part 5, as well as taking a good grip on the curved hand supports 18. The exit position of the baby is not against the curve of the coccyx and the position of the parturient is open towards the staff assisting in the birth, while the body or other parts of the device do not hinder the parturient from moving or the operations of the staff.

FIG. 4 shows a possible position in preparation for delivery, the opening phase, and when giving birth standing. The parturient can then lean her sternum against the leaning support 21 and hold onto the desired point on the gripping curved handle 19. Her elbows or arms can be supported on the armrests 20 or the curved hand supports 18. The immobility and stable structure of the device are of primary importance when pushing. The stability is achieved by the long extending prongs 6 of the support base 4 which permit the support points to be placed as far from each other as possible, and preferably also by the counterweight 23, which is located behind the body 4 relative to the seat part 5. The counterweight presses the device against the floor and compensates for the parturient's weight. In the case of FIG. 5, the counterweight is shown as a separate piece located on top of the support base for reasons of illustration, but it is preferably located inside the support base and hidden from view. The counterweight can be made from steel, lead, concrete, or some other heavy material. The location of the counterweight 23 must not be such as to present a danger of tripping to the support person. FIG. 5 also shows schematically a locking device 25 for attachment to the frame of a bed 24. In this way, the device can be given even more support.

The device according to the invention can be easily integrated with existing delivery rooms and birthing beds. The use of the device does not prevent the normal use of the bed and the end of the bed can be raised, the bed may altered to a transverse table and the pushing phase taken care of using all present techniques, while the device according to the invention is in use. The device permits delivery and pushing while sitting, kneeling, crawling, squatting, and in the Zulu position, in addition to the normal use of the bed. If necessary, the device can be attached directly to the bed, but the structure of the bed must then be sufficiently strong. In principle, the device can also be attached to a wall, with the aid of a suitable attachment arrangement.

In addition to the features described above, various additional pieces of equipment can be attached to the device according to the invention. The most important of these is a infusion stand 26, the preferred location for which is on the bracket arm 7, where there is an attachment 27 for it. The attachment permits the infusion stand to be lowered during the pushing phase. Otherwise, the stand 26 moves with the seat part keeping the height relative to the parturient the same, so that a normal infusion can be given without a pressure pump. The lowering possibility allows the midwife to change infusion bags at her own standing height.

Further, pushing shoes can be fitted to the device for the feet of the parturient, and with their aid guide the parturient in pushing in a favourable direction in terms of muscular resistance.

A detachable and easily washable excrement vessel 28, which can be pushed to the side, as well as a detachable and easily washed cradle-like support frame 29 for the baby, which is preferably also heatable, can be [detachably] attached to the device.

Both of these are attached, in the example of FIG. 1, below the attachment of the seat part 5, being in the same way rotatable around the axis of the auxiliary frame. In the cradle-like baby support frame, the baby can, if necessary be suckled, intubated, resuscitated, and given oxygen. The frame 29 can also be used in such a way that the baby is put onto it until the parturient has settled on the bed. If desired, care devices or monitors and instrument bases as required and according to the level of equipment desired by the user can be integrated with and attached to the device.

The cleaning and hygiene of a device used in a hospital has naturally been made as good as possible. The body and other parts are designed to be as easily cleaned and kept clean as possible. It will be obvious to one skilled in the art that the various embodiments of the invention are also not restricted solely to the examples described above, and can therefore vary within the scope of the Claims stated hereinafter.

The use of the device is not restricted solely to birthing, but extends also to pre and post natal rehabilitation and to other rehabilitation, such as exercise of the pelvic-floor muscles and strengthening of the lower back and rehabilitation of the paralysed. In the future, it may perhaps also be used in breast feeding and in various exercise and leisure pursuits, either as such or with accessories.

The adjustment of the position of the device can be not only manual but also automatic (pneumatic or hydraulic or some other non-manual adjustment). This may be necessary particularly, for example, in a version outside of a birthing bed or of a delivery room. Various rugged, but easily detachable foot supports can also be attached to the device. The choice of materials takes into account the highest requirements of hospital hygiene and the fact that no seams may be facing upwards or on top. This avoids the risk of contamination. All pivots too can be covered with shields or similar while the seat lift and the body part are protected from splashes.

The body or its vertical part can be fitted on a rotating pivot, so that the seat part and the support elements can be rotated around the vertical axis of the body. This may facilitate assisting the parturient, for instance, when she is taken to into the birthing room on the birthing aid and must be transferred to a birthing bed according to the invention. In this case the rotating frame then means that the stand of the device need not be turned, instead the parturient can be turned on top of the bed supported by the device. So the rotation is then faster and needs less space. The body can also be formed as a pivoted mechanism like a robot arm or excavator boom, giving the device greater movement possibilities. The curved hand supports can be joined together at their ends as a unified curve, or the curved parts can be replaced with ones that are straight and bent at an angle.

The invention claimed is:

1. A device for assisting parturition, which device comprises:

at least one body part, a seat part for the parturient, in which seat part there is a cut-out for the exit of the baby, elements connecting the seat part to the body part, a back rest for the parturient, and at least one set of support elements, which the parturient can grip, including an annular gripping handle surrounding the back rest and a transverse gripping bar extending horizontally across the annular gripping handle, wherein the seat part is connected to the body part in such a way that the cut-out faces away from the body part and the elements for connecting to the body part are between the body part and the seat part, and the seat part can be turned laterally relative to the body part around at least one axis of rotation to the side from an operating position and turning of the seat part will also facilitate transferring the parturient on a bed.

2. The device according to claim 1, further comprising an element fitted to the body part, by which the parts connecting the seat part to the body part are attached to the body in such a way that the height of at least the seat part can be adjusted.

3. The device according to claim 1, further comprising a support base, to which the body part is fitted.

4. The device according to claim 3, further comprising a cut-out formed in the support base, which faces away from the body part.

5. The device according to claim 3, wherein the body part is situated asymmetrically on the support base, i.e. to the side of the centre line of the support base.

6. The device according to claim 1, wherein the device can be attached, to be moved in at least three directions and by a quick-release attachment, to a bed, such as a hospital bed, on top of the bed, to be used above it.

7. The device according to claim 6, wherein the height of at least the seat part is adjusted manually, mechanically, electrically, or pneumatically, together with, or separately from the hospital bed.

8. The device according to claim 1, further comprising prongs in the seat part.

9. The device according to claim 1, further comprising a counterweight fitted on the opposite side of the body part to the seat part.

10. The device according to claim 1, wherein a movable support base can be attached to the device.

11. The device according to claim 1, wherein a movable collection vessel can be attached to the device.

12. The device according to claim 1, further comprising seat prongs in the seat part, which are detachable.

13. The device according to claim 1, wherein at least the seat part is attached to an auxiliary frame and the auxiliary frame is attached to the body part by two brackets.

14. The device according to claim 13, wherein at least the seat part is attached to an auxiliary frame and the auxiliary frame is attached by two brackets to a guide in the body part, in order to adjust the height of the auxiliary frame and the devices attached to it.

15. The device according to claim 13, further comprising an infusion stand attached with vertical adjustment to the brackets.

16. The device according to claim 1, wherein the body part is formed of a pivoted mechanism.

17. The device according to claim 14, further comprising an infusion stand attached with vertical adjustment to the bracket.

18. The device according to claim 1, wherein the seat part can be turned independently of the back rest.

* * * * *